US012668963B2

(12) United States Patent
Matsushita et al.

(10) Patent No.: US 12,668,963 B2
(45) Date of Patent: Jun. 30, 2026

(54) TOILET DEVICE

(71) Applicant: TOTO LTD., Kitakyushu (JP)

(72) Inventors: Hiroyoshi Matsushita, Kitakyushu (JP); Ryuichi Kumamoto, Kitakyushu (JP); Satoshi Nakada, Kitakyushu (JP); Shohei Ogawa, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 85 days.

(21) Appl. No.: 18/761,418

(22) Filed: Jul. 2, 2024

(65) Prior Publication Data

US 2025/0012067 A1 Jan. 9, 2025

(30) Foreign Application Priority Data

Jul. 4, 2023 (JP) ..... 2023-110136

(51) Int. Cl.
*E03D 9/052* (2006.01)

(52) U.S. Cl.
CPC ..... *E03D 9/052* (2013.01)

(58) Field of Classification Search
CPC ..... E03D 9/052; A47K 13/30
USPC ..... 4/209, 111.1, 306, 347, 477, 679
See application file for complete search history.

(56) References Cited

U.S. PATENT DOCUMENTS 5,539,937 A * 7/1996 Barefoot ..... A47K 13/307 4/213
6,052,837 A 4/2000 Norton et al.
6,526,598 B1 * 3/2003 Black ..... F03G 1/022 4/217
6,643,850 B2 * 11/2003 Chasen ..... E03D 9/052 4/220
6,694,534 B2 * 2/2004 Stone ..... E03D 9/052 4/228.1
8,136,172 B1 * 3/2012 Edgecombe ..... A47K 13/30 4/237
11,634,899 B2 * 4/2023 Salazar ..... A47K 13/307 4/347
2003/0177568 A1 * 9/2003 Chasen ..... E03D 9/052 4/213
2011/0047686 A1 * 3/2011 Moore ..... E03D 9/052 4/213
2024/0328137 A1 * 10/2024 Sollami ..... E03D 9/05

FOREIGN PATENT DOCUMENTS

CA 2079299 C * 6/1995 ..... A47K 13/307
CN 106232910 A * 12/2016 ..... E03D 9/05
CN 108755887 A * 11/2018 ..... E03D 9/052
CN 119860037 A * 4/2025 ..... E03D 11/06
(Continued)

*Primary Examiner* — Lori L Baker
(74) *Attorney, Agent, or Firm* — McDonald Hopkins LLC

(57) ABSTRACT

A toilet device includes a casing and a deodorizing unit provided inside the casing and configured to deodorize air in a toilet room. The deodorizing unit includes a duct and a fan configured to suction air into the duct. The duct includes a first extending portion extending from the casing, a second extending portion extending from the casing at a position different from a position of the first extending portion, and a connection portion connecting the first extending portion and the second extending portion. The first extending portion, the second extending portion, and the connection portion are integrally formed with the casing.

12 Claims, 8 Drawing Sheets

(56) References Cited

FOREIGN PATENT DOCUMENTS

| | | | | | |
|---|---|---|---|---|---|
| CN | 120021898 | A | * | 5/2025 | E03D 9/00 |
| DE | 202004012063 | U1 | * | 12/2005 | F24F 8/192 |
| DE | 202012006005 | U1 | * | 9/2012 | E03D 9/052 |
| DE | 202012104219 | U1 | * | 12/2012 | E03D 9/052 |
| EP | 2261428 | A1 | * | 12/2010 | E03D 9/08 |
| JP | H05-047075 | U | | 6/1993 | |
| JP | H07-002576 | U | | 1/1995 | |
| JP | H11131567 | A | * | 5/1999 | E03D 9/08 |
| JP | H11-253361 | A | | 9/1999 | |
| JP | 2014520984 | A | * | 8/2014 | E03D 9/052 |
| JP | 2016-148188 | A | | 8/2016 | |
| JP | 2017014692 | A | * | 1/2017 | E03D 9/08 |
| JP | 2021080642 | A | * | 5/2021 | E03D 9/08 |
| JP | 2022048839 | A | * | 3/2022 | E03D 9/08 |
| JP | 7462880 | B2 | * | 4/2024 | E03D 9/08 |
| KR | 20140024675 | A | * | 3/2014 | A47K 13/30 |
| KR | 20160141923 | A | * | 12/2016 | E03D 9/052 |
| TW | I797371 | B | * | 4/2023 | E03D 9/005 |
| WO | WO-0243548 | A1 | * | 6/2002 | A47K 13/30 |
| WO | WO-2010110511 | A1 | * | 9/2010 | E03D 9/052 |
| WO | WO-2018100982 | A1 | * | 6/2018 | E03D 9/052 |

* cited by examiner

TOILET DEVICE

CROSS-REFERENCE TO RELATED APPLICATIONS

This application is based upon and claims the benefit of priority from Japanese Patent Application No. 2023-110136, filed on Jul. 4, 2023; the entire contents of which are incorporated herein by reference.

FIELD

Aspects of the present invention relate generally to a toilet device.

BACKGROUND

Some known toilet devices include, inside a casing, a deodorizing unit that can deodorize a toilet bowl (Patent Document 1: JP 2016-148188 A). The deodorizing unit includes a fan that suctions air in the toilet bowl and a duct through which the suctioned air flows.

The duct described in Patent Document 1 is configured by combining two components which are obtained by dividing the duct in an up-down direction. Because of this, air may leak from a gap at a joining portion between the components, and thus deodorization performance may be impaired.

The present invention has been made in light of this problem, and the object thereof is to provide a toilet device having an improved deodorization performance.

SUMMARY

According to a first aspect of the present invention, a toilet device includes a casing and a deodorizing unit provided inside the casing and configured to deodorize air in a toilet room. The deodorizing unit includes a duct and a fan configured to suction air into the duct. The duct includes a first extending portion extending from the casing, a second extending portion extending from the casing at a position different from a position of the first extending portion, and a connection portion connecting the first extending portion and the second extending portion. The first extending portion, the second extending portion, and the connection portion are integrally formed with the casing.

In this toilet device, the entire duct is integrated with the casing, making it possible to improve an airtightness of the duct. Accordingly, air leakage from the duct can be suppressed, making it possible to improve a quietness and improve deodorization performance. Further, assembly of the duct is not required, making it possible to reduce the number of assembly steps.

A second aspect of the present invention is the toilet device according to the first aspect, in which the duct includes an intake through which air is suctioned, an exhaust port from which deodorized air is exhausted, and a passage portion via which the intake and the exhaust port communicate with each other, the passage portion being formed by the first extending portion, the second extending portion, and the connection portion. The passage portion is integrally formed with the casing from the intake to the exhaust port.

According to this toilet device, the entire passage portion is formed integrally with the casing, making it possible to further improve the airtightness of the duct. This makes it possible to improve the deodorization performance of the deodorizing unit.

A third aspect of the present invention is the toilet device according to the second aspect, in which the fan includes a rotary shaft extending upward with respect to a bottom surface portion of the casing, and the fan exhausts air in a direction orthogonal to the rotary shaft.

According to this toilet device, the rotary shaft of the fan extends upward with respect to the bottom surface portion of the casing and air is exhausted in a direction orthogonal to the rotary shaft. Thus, it is possible to suppress an increase in a height dimension of the casing, even when blades of the fan are made larger. Accordingly, it is possible to provide a toilet device that is overall compact and has a good design.

A fourth aspect of the present invention is the toilet device according to the second or the third aspect, in which the passage portion includes a first passage portion positioned on the intake side, and a second passage portion positioned on the exhaust port side. The fan is disposed between the first passage portion and the second passage portion.

According to this toilet device, by disposing the fan between the first passage portion and the second passage portion of the duct, it is possible to dispose the fan in consideration of the effect of pressure loss due to a shape of the duct. Furthermore, by disposing the fan between the first passage portion and the second passage portion, it is possible to dispose the fan in the duct without impairing the airtightness of the duct integrated with the casing. This makes it possible to improve the deodorization performance of the deodorizing unit.

A fifth aspect of the present invention is the toilet device according to the fourth aspect, in which the second passage portion is bent at an obtuse angle in a flow direction of air.

According to this toilet device, it is possible to reduce the pressure loss when air flows through the second passage portion. This makes it possible to improve the deodorization performance of the deodorizing unit.

A sixth aspect of the present invention is the toilet device according to the first aspect, in which the casing includes a fixing portion at which the fan is fixed with a screw.

According to this toilet device, by fixing the fan to the fixing portion of the casing with a screw, it is possible to suppress displacement of the fan due to vibration or the like. Accordingly, the deodorization performance of the deodorizing unit can be improved. Further, by adopting a structure in which the fixing portion is fixed by a screw, it is possible to increase durability more than when fixed by a hook or the like. Accordingly, it is possible to suppress breakage of the fixing portion and help prevent having to replace the entire casing due to the fixing portion breaking, for example.

DETAILED DESCRIPTION

Figure 1:
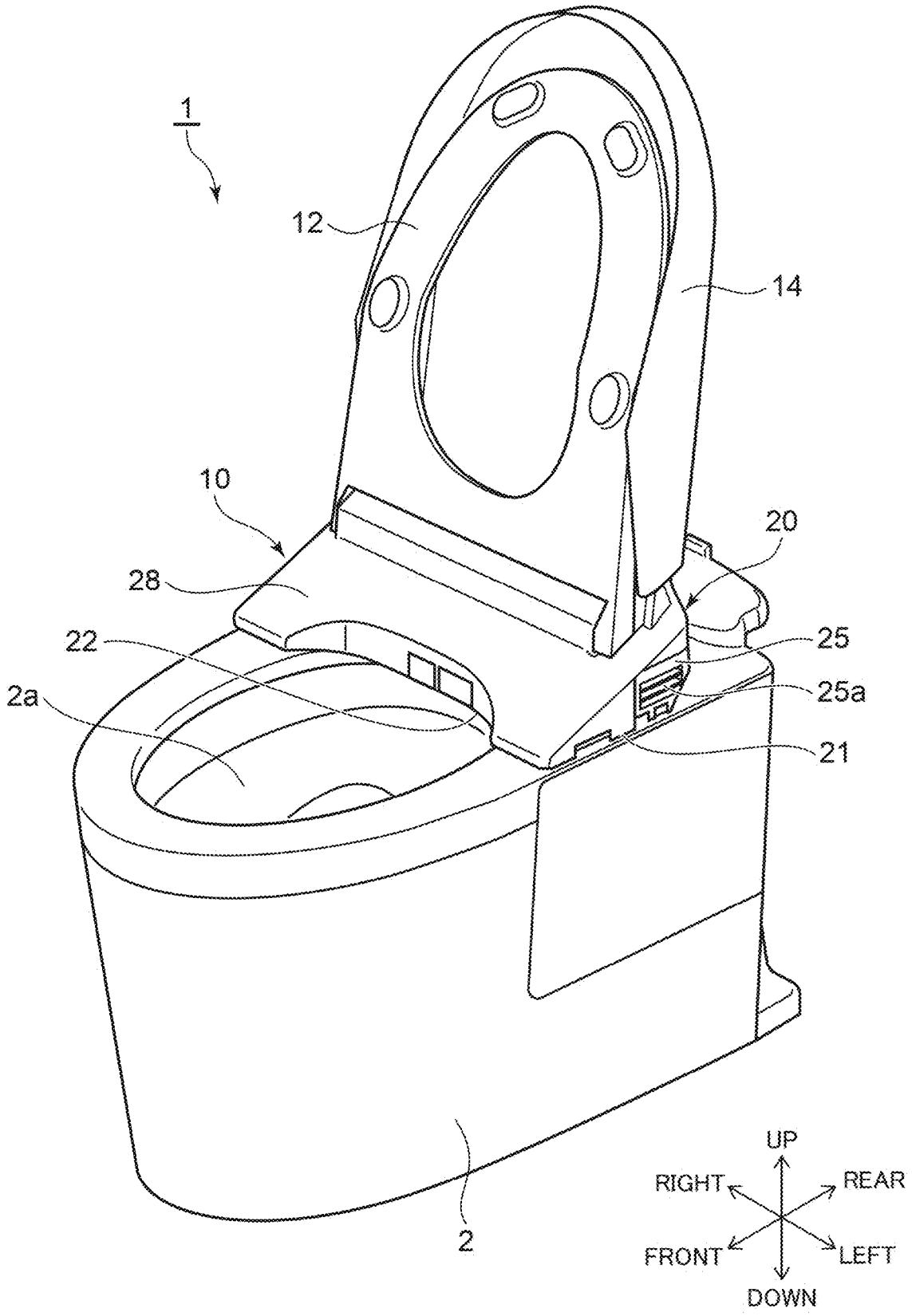
FIG. 1 is a perspective view illustrating a toilet including a toilet device according to an embodiment.

Hereinafter, embodiments will be described with reference to the drawings. Note that, in the drawings, similar components are denoted by like reference signs, and detailed description thereof will be omitted as appropriate.

FIG. 1 is a perspective view illustrating a toilet including a toilet device according to an embodiment.

As illustrated in FIG. 1, a toilet 1 includes a Western sit toilet bowl (hereinafter, simply referred to as a "toilet bowl" for convenience of description) 2 and a toilet device 10 attached to an upper surface of the toilet bowl 2. The toilet bowl 2 includes a bowl portion 2*a* that receives excrement. The toilet device 10 includes a toilet seat 12, a toilet lid 14, and a casing 20. The toilet seat 12 and the toilet lid 14 are each pivotally supported in an openable and closable manner with respect to the casing 20. In the present specification, the terms "up," "down," "front," "rear," "right," and "left" refer to directions as viewed by a user sitting on the toilet seat 12 with his/her back facing the toilet lid 14 in an open state.

The toilet device 10 is attached to the upper surface of the toilet bowl 2 at the rear of the toilet bowl 2. The toilet device 10 may be integrally attached to the toilet bowl 2 or may be detachably attached to the toilet bowl 2. The toilet device 10 includes the casing 20 formed in a box shape with a hollow inside, and a deodorizing unit 30 provided inside the casing 20 and configured to reduce odorous components.

The casing 20 also includes functional units inside thereof as necessary. Examples of the functional include an opening/closing unit that controls opening/closing operations of the toilet seat 12 and the toilet lid 14, a toilet seat heating unit that controls a temperature of the toilet seat 12, a private part washing unit that washes a private part of a human body, and a communication unit configured to communicate with an operation unit such as a remote control. Note that the toilet lid 14 is provided to the toilet device 10 as necessary and can be omitted.

Figure 2:
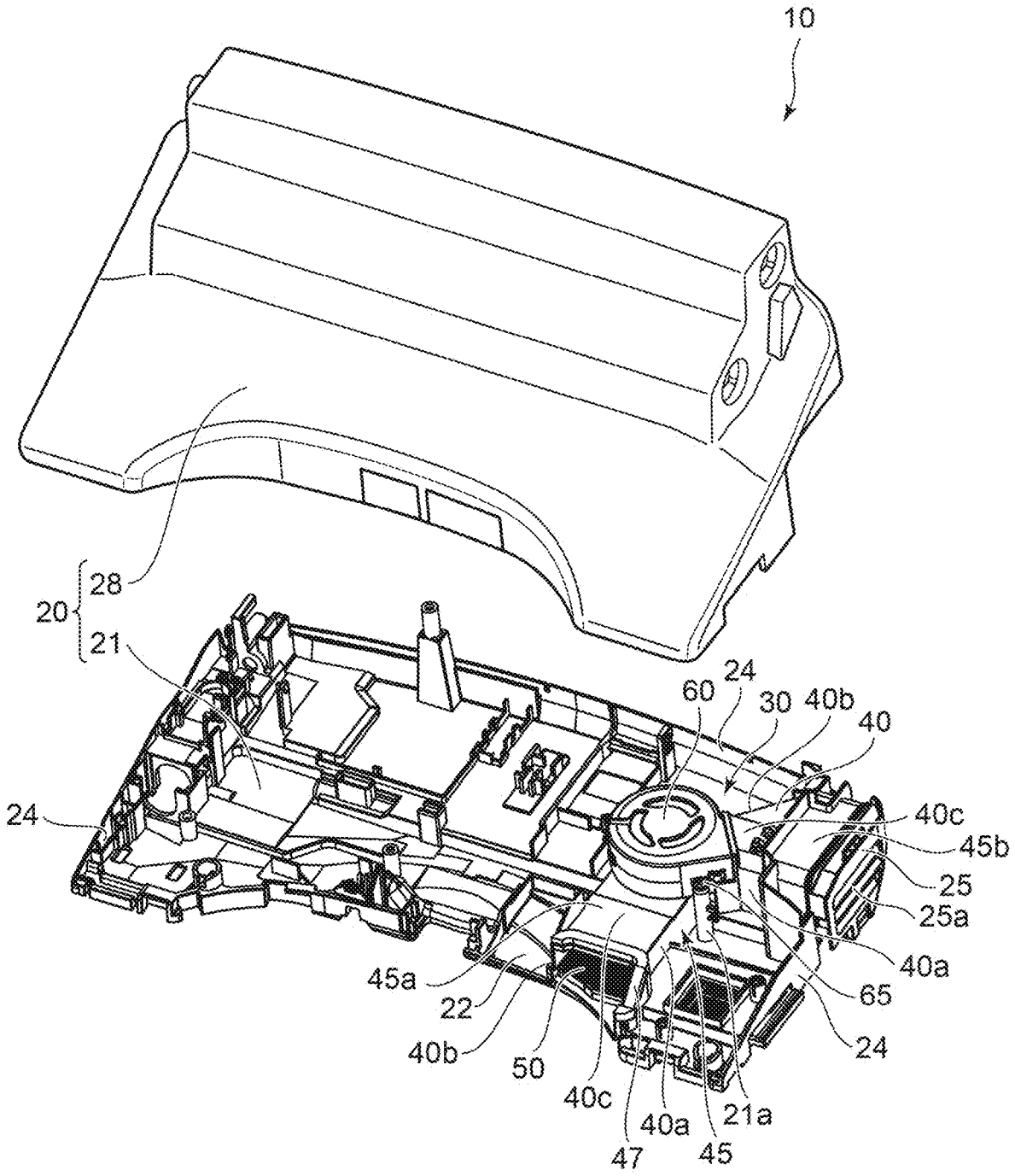
FIG. 2 is an exploded perspective view illustrating a state in which a case cover is removed from a case plate.

FIG. 2 is an exploded perspective view illustrating a state in which a case cover is removed from a case plate.

Figure 3:
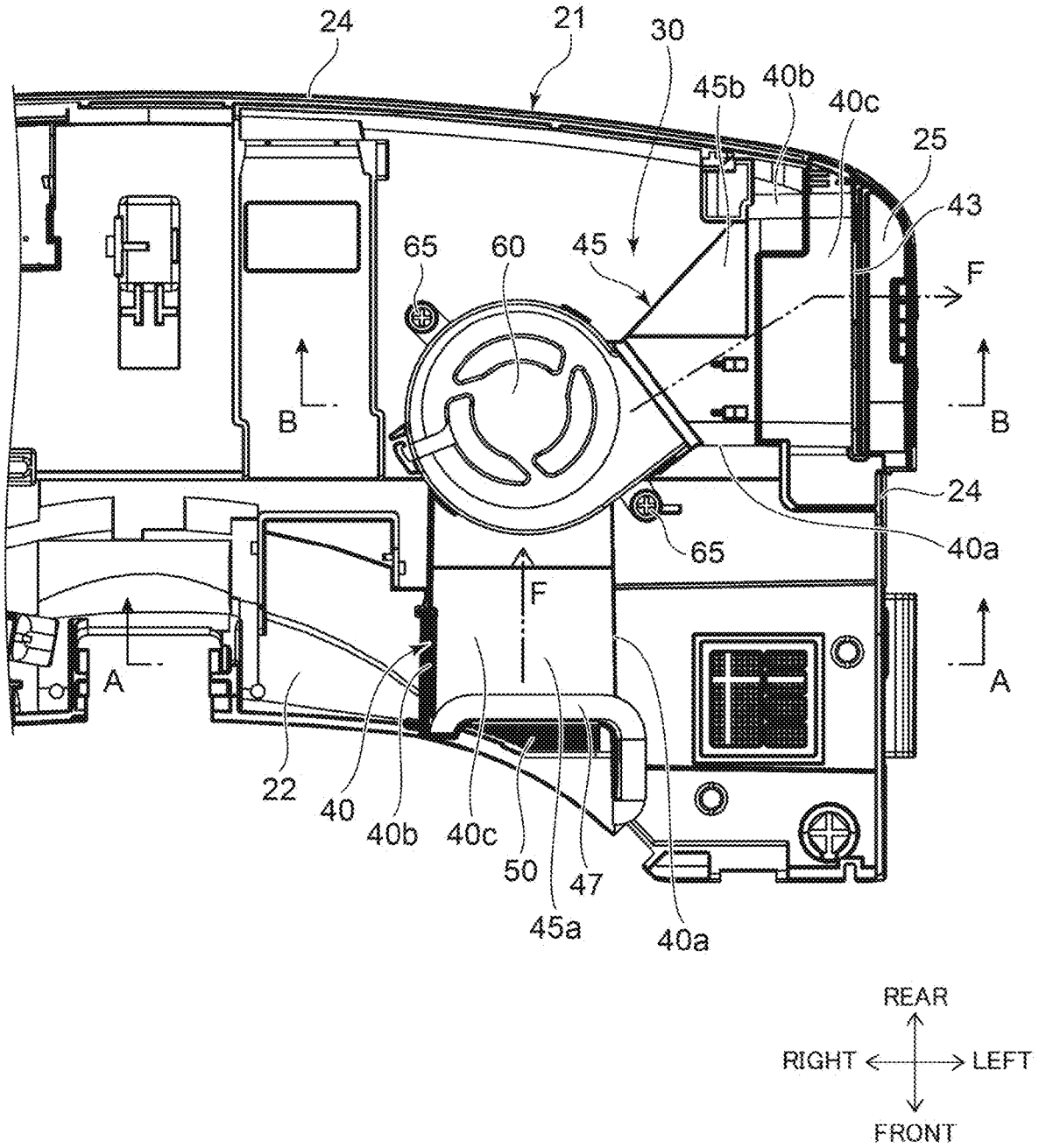
FIG. 3 is a plan view of a deodorizing unit viewed from above.

FIG. 3 is a plan view of the deodorizing unit viewed from above.

Figure 4:
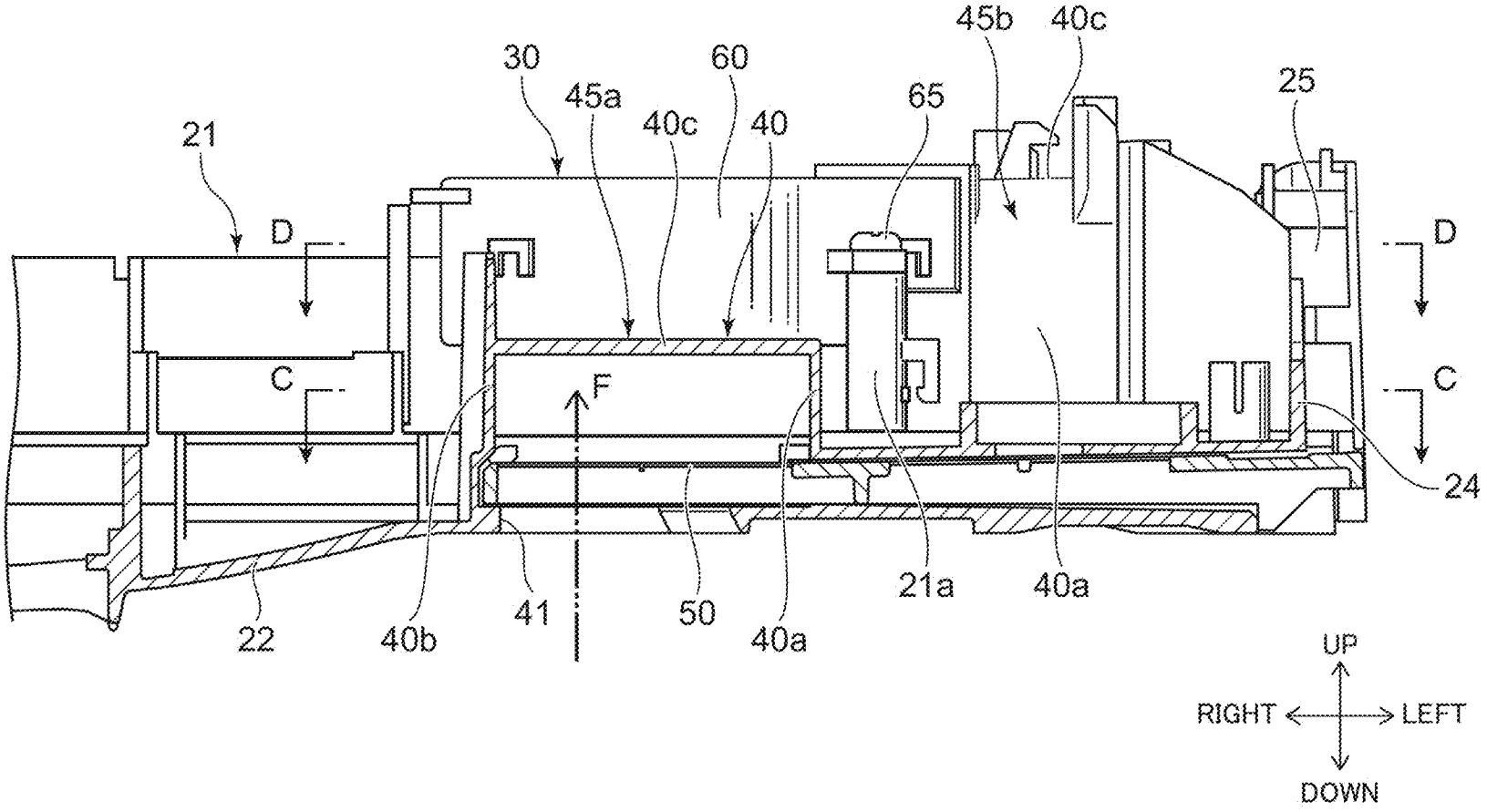
FIG. 4 is a cross-sectional view of the case plate and the deodorizing unit taken along line A-A in FIG. 3.

FIG. 4 is a cross-sectional view of the case plate and the deodorizing unit taken along line A-A in FIG. 3.

Figure 5:
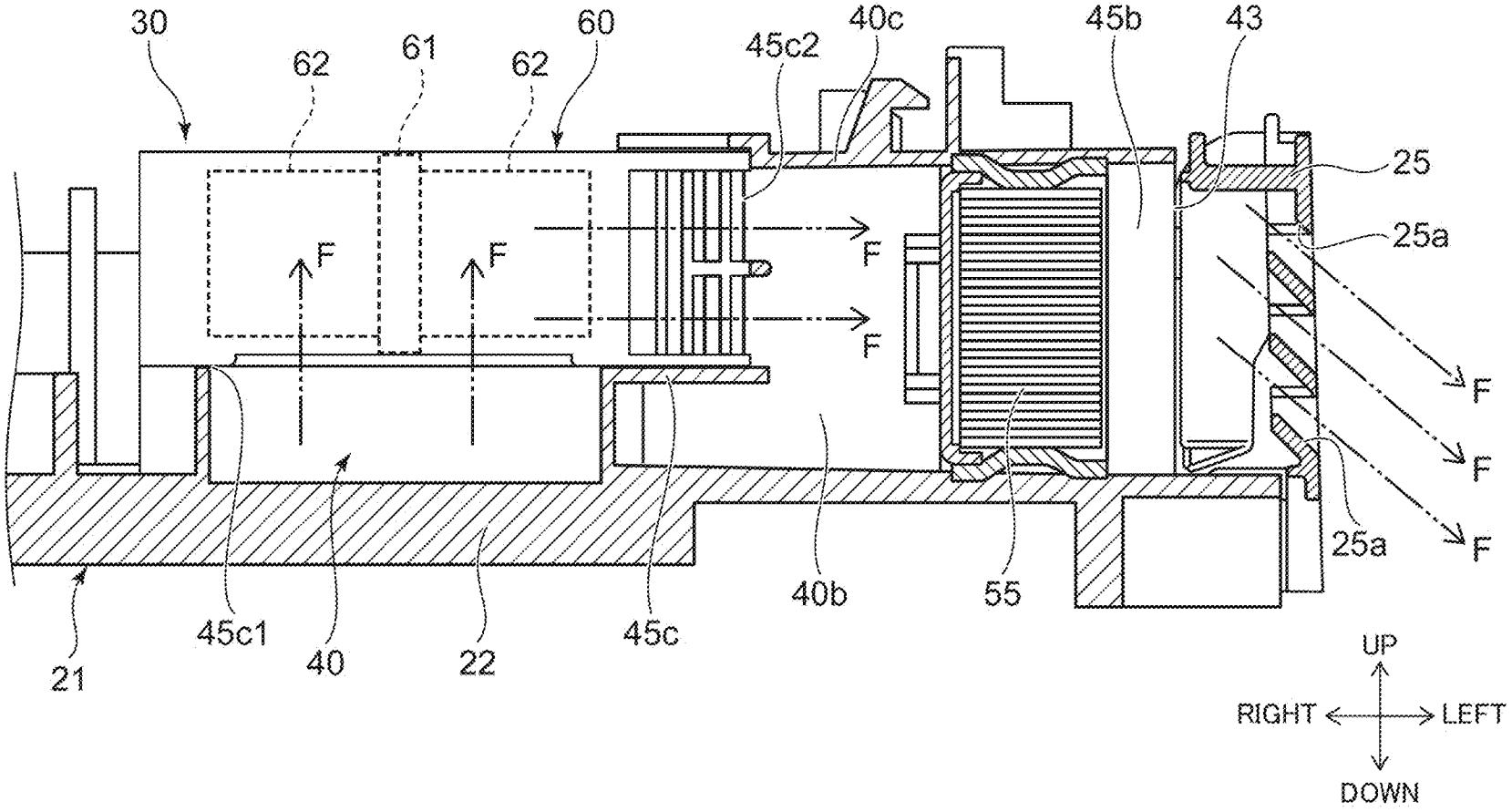
FIG. 5 is a cross-sectional view of the case plate and the deodorizing unit taken along line B-B in FIG. 3.

FIG. 5 is a cross-sectional view of the case plate and the deodorizing unit taken along line B-B in FIG. 3.

Figure 6:
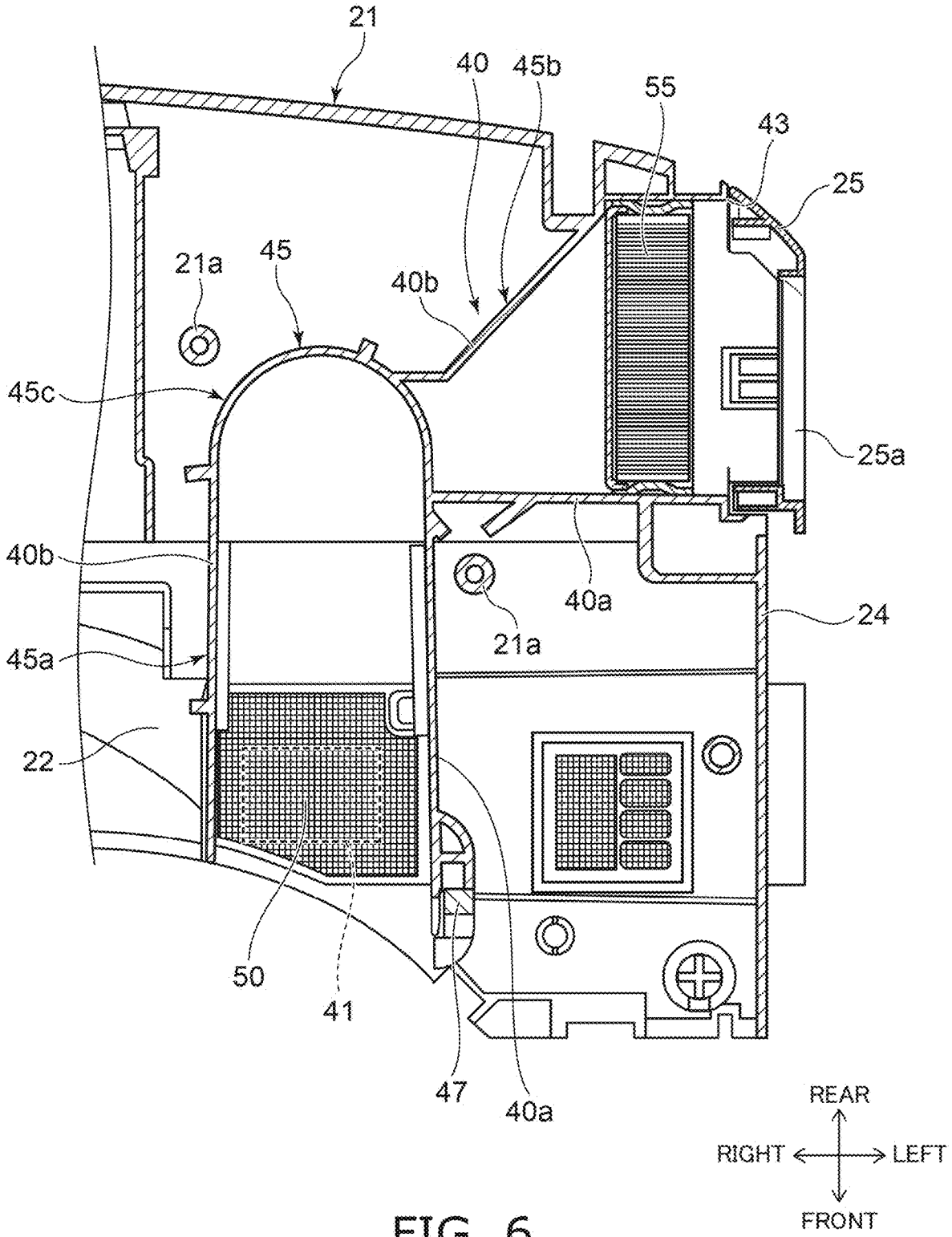
FIG. 6 is a cross-sectional view of the case plate and the deodorizing unit taken along line C-C in FIG. 4.

FIG. 6 is a cross-sectional view of the case plate and the deodorizing unit taken along line C-C in FIG. 4.

Figure 7:
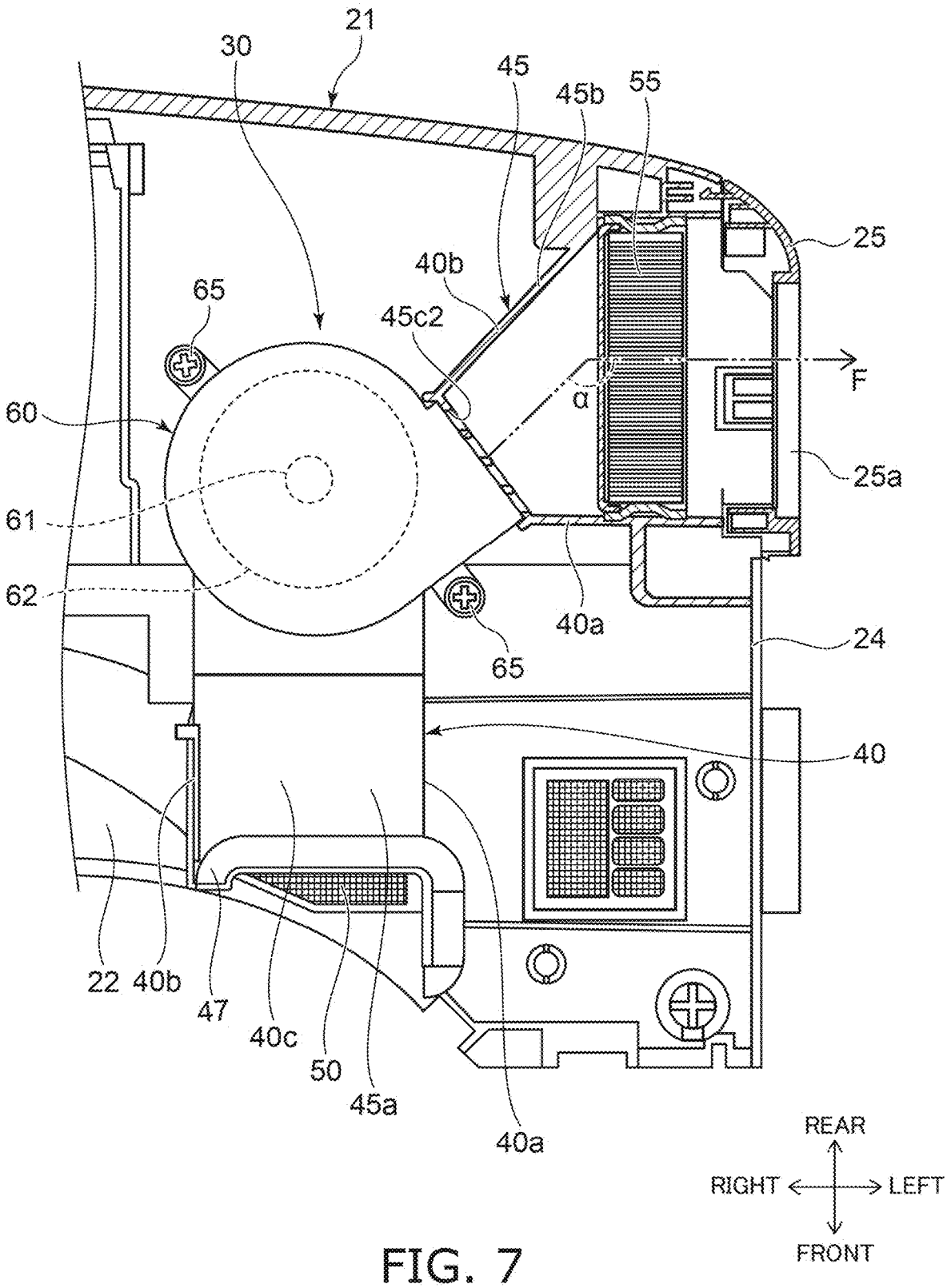
FIG. 7 is a cross-sectional view of the case plate and the deodorizing unit taken along line D-D in FIG. 4.

FIG. 7 is a cross-sectional view of the case plate and the deodorizing unit taken along line D-D in FIG. 4.

Figure 8:
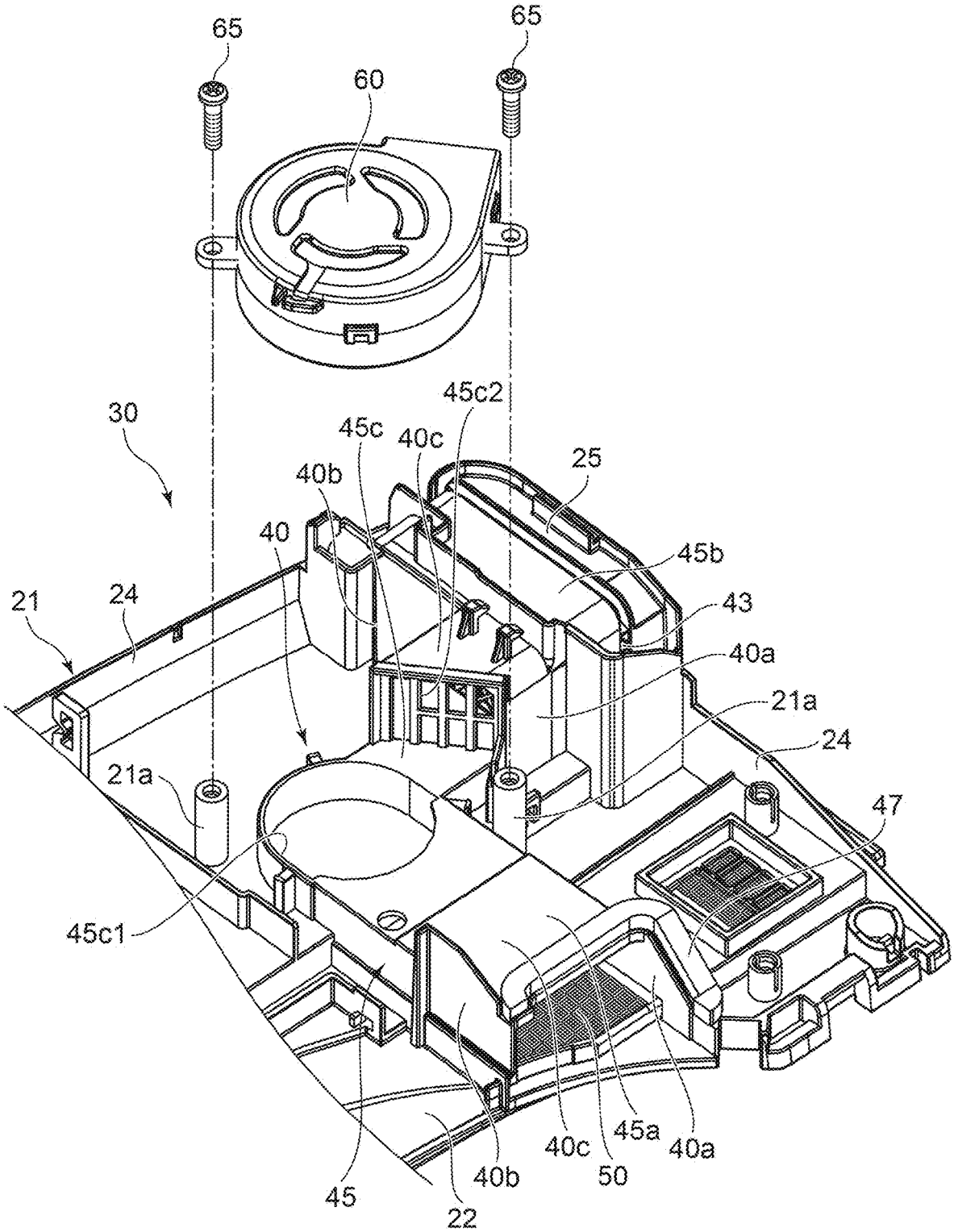
FIG. 8 is an exploded perspective view illustrating a state in which a fan is removed from the case plate.

FIG. 8 is an exploded perspective view illustrating a state in which a fan is removed from the case plate.

The casing 20 includes a case plate 21 and a case cover 28 attached to the case plate 21. Functional units such as the deodorizing unit 30 and the toilet seat heating unit are mounted on the case plate 21. In the drawings, functional units other than the deodorizing unit 30 are omitted for convenience of description. The case cover 28 is formed in a box shape that opens downward. The case cover 28 covers the functional units provided on the case plate 21.

The case plate 21 includes a bottom surface portion 22 and a side surface portion 24 extending upward from the bottom surface portion 22. The bottom surface portion 22 includes an intake 41 (described below), which is a portion of the deodorizing unit 30. The side surface portion 24 includes an exhaust port 43, which is a portion of the deodorizing unit 30. As illustrated in FIG. 2 to FIG. 8, a detachable lid portion 25 is attached to the exhaust port 43. An opening 25*a* for exhausting air F from the exhaust port 43 is formed in the lid portion 25.

Next, the deodorizing unit 30 will be described.

The deodorizing unit 30 is provided inside the casing 20 and deodorizes the air in the toilet room. Specifically, the deodorizing unit 30 deodorizes air suctioned from the intake 41 and exhausts deodorized air into the toilet room from the exhaust port 43. The deodorizing unit 30 is provided on the case plate 21. The deodorizing unit 30 includes a duct 40 and a fan 60.

The duct 40 is provided integrally with the case plate 21 of the casing 20. The duct 40 forms a flow path through which the suctioned air F flows. The duct 40 includes a first extending portion 40*a* extending from the bottom surface portion 22 of the case plate 21, a second extending portion 40*b* extending from the bottom surface portion 22 of the case plate 21 at a position different from that of the first extending portion 40*a*, and a connection portion 40*c* connecting the first extending portion 40*a* and the second extending portion 40*b*.

The first extending portion 40*a* is integrally connected to the bottom surface portion 22 of the case plate 21 at a lower end side, and extends upward. The first extending portion 40*a* constitutes, for example, a left side surface portion of the duct 40. The second extending portion 40*b* is integrally connected to the bottom surface portion 22 of the case plate 21 at a lower end side, and extends upward. The second extending portion 40*b* constitutes, for example, a right side surface portion of the duct 40. That is, the second extending portion 40*b* faces the first extending portion 40*a*.

The connection portion 40*c* connects an upper end of the first extending portion 40*a* and an upper end of the second extending portion 40*b*. The connection portion 40*c* is integrally connected to the first extending portion 40*a* and the second extending portion 40*b*. The connection portion 40*c* constitutes, for example, an upper surface portion of the duct 40. The first extending portion 40*a*, the second extending portion 40*b*, and the connection portion 40*c* are formed integrally with the case plate 21 of the casing 20. That is, the duct 40 cannot be removed from the case plate 21.

The duct 40 includes the intake 41, the exhaust port 43, and a passage portion 45 via which the intake 41 and the exhaust port 43 communicate with each other. As illustrated in FIG. 4, the intake 41 is formed in the bottom surface portion 22 of the case plate 21. The intake 41 is positioned above the bowl portion 2*a* of the toilet bowl 2. As a result, the air in the toilet room is suctioned into the passage portion 45 from the intake 41 through the bowl portion 2*a*.

As illustrated in FIG. 4 and FIG. 6, a first filter 50 is provided in the passage portion 45, covering the intake 41. The first filter 50 is, for example, a dust collection filter and helps prevent dust from entering the passage portion 45. The first filter 50 also helps prevent excrement splashing up from the bowl portion 2*a* from entering the passage portion 45.

The exhaust port 43 is formed in the side surface portion 24 of the case plate 21. As illustrated in FIG. 5 to FIG. 7, the detachable lid portion 25 is attached to the exhaust port 43. A second filter 55 is provided in the passage portion 45 and can be removed from the exhaust port 43. That is, the user can remove the lid portion 25 to replace the second filter 55. The second filter 55 includes a deodorizing catalyst that removes odorous components from the air F that flows through the passage portion 45 and contains the odorous components.

The passage portion 45 is formed by the first extending portion 40*a*, the second extending portion 40*b*, and the connection portion 40*c*, and the intake 41 and the exhaust port 43 communicate with each other via the passage portion 45. The passage portion 45 is integrally formed with the case plate 21 of the casing 20 from the intake 41 to the exhaust port 43. The air F suctioned from the intake 41 flows toward the exhaust port 43 through an internal space surrounded by the bottom surface portion 22 of the case plate 21, the first extending portion 40*a*, the second extending portion 40*b*, and the connection portion 40*c*.

The passage portion 45 includes a first passage portion 45*a* positioned on the intake 41 side and a second passage portion 45*b* positioned on the exhaust port 43 side. An attaching portion 45*c* for attaching the fan 60 is provided between the first passage portion 45*a* and the second passage portion 45*b*. As illustrated in FIG. 8, the attaching portion 45*c* is open upward and does not include the connection portion 40*c*. The first passage portion 45*a* and the second passage portion 45*b* are connected by the fan 60.

The first passage portion 45*a* extends from the intake 41 toward the attaching portion 45*c*. A front end opening of the first passage portion 45*a* is covered with the case cover 28 via a sealing member 47. The second passage portion 45*b* extends from the attaching portion 45*c* toward the exhaust port 43. As illustrated in FIG. 4 and FIG. 8, the connection portion 40*c* of the second passage portion 45*b* is positioned higher than the connection portion 40*c* of the first passage portion 45*a*. The attaching portion 45*c* includes an inflow port 45*c*1 through which the air F flows in from the first passage portion 45*a* to the fan 60 and an outflow port 45*c*2 through which the air F flows out from the fan 60 to the second passage portion 45*b*.

As illustrated in FIG. 7, the outflow port 45*c*2 faces obliquely rearward to the left. Thus, the second passage portion 45*b* is bent at an obtuse angle in a flow direction of the air F. That is, primary flow of the air F flowing out from the outflow port 45*c*2 is redirected at an angle $\alpha$ ($90° < \alpha < 180°$) and exhausted from the exhaust port 43. This reduces pressure loss when the air F flows through the second passage portion 45*b*. Accordingly, the deodorizing unit 30 can facilitate the flow of the air F flowing from the second passage portion 45*b* toward the exhaust port 43, and thus deodorization performance can be improved.

The fan 60 is positioned inside the casing 20 and is disposed on the attaching portion 45*c* between the first passage portion 45*a* and the second passage portion 45*b*. The fan 60 is a suction fan that suctions the air in the bowl portion 2*a* and the toilet room. Examples of the fan 60 include a fan that blows air in a centrifugal direction of rotation, such as a sirocco fan or a centrifugal fan, and a fan that blows air in an axial direction of rotation, such as an axial fan.

As illustrated in FIG. 5, the fan 60 is, for example, a sirocco fan, and includes a rotary shaft 61 and blades 62 provided around the rotary shaft 61, and an air outlet of the fan 60 faces in a direction orthogonal to the rotary shaft 61. That is, the rotary shaft 61 extends upward with respect to the bottom surface portion 22 of the casing 20 (case plate 21), and the fan 60 exhausts the air F in a direction orthogonal to the rotary shaft 61. The fan 60 suctions the air F from below to above and exhausts the air F in a lateral direction. Thus, when the fan 60 is activated, the air F flows upward from the inflow port 45*c*1 (first passage portion 45*a*) and flows obliquely rearward to the left (second passage portion 45*b*) from the outflow port 45*c*2.

The fan 60 is fixed to the casing 20 by screws 65. The case plate 21 includes fixing portions 21*a* for fixing the fan 60 with screws. That is, each fixing portion 21*a* is a screw fastener including female threads with which the screw 65 is screwed. For example, two fixing portions 21*a* are provided side by side in line with the attaching portion 45*c*. The fan 60 is positioned on the attaching portion 45*c* and attached to the case plate 21 by the screws 65.

Fixing the fan 60 to the fixing portions 21*a* of the casing 20 with screws makes it possible to help prevent displacement of the fan 60 due to vibration or the like. Accordingly, the deodorization performance of the deodorizing unit 30 can be improved. Further, a structure in which the fan 60 is fixed to the fixing portion 21*a* by screws is more durable than a structure in which the fan 60 is fixed by hooks, for example. Accordingly, it is possible to suppress breakage of the fixing portion 21*a* and help prevent having to replace the entire casing 20 due to the fixing portion 21*a* breaking, for example.

The toilet device 10 according to the present embodiment has the configuration described above. Next, the action of the deodorizing unit 30 will be described.

A control device (not illustrated) provided inside the casing 20 activates the fan 60 for a predetermined time upon detection that the user is away from the toilet seat 12 or at predetermined time intervals, for example, thereby causing the air F containing odorous components to be suctioned from the intake 41 into the duct 40. In this case, dust in the air F is collected by the first filter 50 provided in the intake 41. Thus, the air F can be cleaned and adhesion of the dust to the rotary shaft 61 and the blades 62 of the fan 60 can be reduced.

The air F flowing from the intake 41 into the first passage portion 45*a* flows from the first passage portion 45*a* to the second passage portion 45*b* via the fan 60 by activation of the fan 60. The air F flowing into the second passage portion 45*b* passes through the second filter 55, which removes odorous components. The air F after the odorous components are removed flows out to the toilet room from the opening 25*a* of the lid portion 25 through the exhaust port 43.

Here, in a case in which the duct is formed separately from the casing, for example, a joining portion is formed between the casing and the duct. In this case, the air suctioned into the duct may leak from the joining portion. When the air leaks from the inside of the duct, the deodorization performance may deteriorate and a whistling phenomenon may occur when the air leaks from the joining portion. Further, when the casing vibrates due to activation of the functional units accommodated inside the casing, a rattling noise may be generated at the joining portion between the casing and the duct.

In the present embodiment, the first extending portion 40*a*, the second extending portion 40*b*, and the connection portion 40*c* forming the duct 40 are formed integrally with the case plate 21 of the casing 20. This provides the deodorizing unit 30 with the duct 40 having the improved airtightness. Accordingly, in the deodorizing unit 30, the leakage of the air F from the inside of the duct 40 can be suppressed, and thus it is possible to improve quietness and improve the deodorization performance. Further, since the duct 40 vibrates together with the case plate 21, the rattling noise can be suppressed. Additionally, there is no need to assemble the duct 40, making it possible to reduce the number of assembly steps. Furthermore, since the duct 40 is integrated with the case plate 21, the strength of the case plate 21 can be increased.

In this case, the passage portion 45 is formed integrally with the case plate 21 of the casing 20 from the intake 41 to the exhaust port 43. Since the entire passage portion 45 is formed integrally with the casing 20, the airtightness of the duct 40 can be further improved. Accordingly, the toilet device 10 makes it possible to improve the deodorization performance of the deodorizing unit 30.

Further, the fan 60 is disposed between the first passage portion 45*a* and the second passage portion 45*b*. With the fan 60 disposed between the first passage portion 45*a* and the second passage portion 45*b* of the duct 40, the fan 60 can be disposed in consideration of the effect of pressure loss due to the shape of the duct 40. Furthermore, with the fan 60 disposed between the first passage portion 45*a* and the second passage portion 45*b*, the fan 60 can be disposed in the duct 40 without impairing the airtightness of the duct 40 integrated with the casing 20. Thus, the toilet device 10 makes it possible to improve the deodorization performance of the deodorizing unit 30.

Further, the fan 60 is a sirocco fan. In the sirocco fan, the rotary shaft 61 extends upward with respect to the bottom surface portion 22 of the casing 20. This can help prevent an increase in a height dimension of the casing 20 even when the blade 62 of the fan 60 is made larger. Accordingly, it is possible to provide the toilet device 10 that is overall compact and has a good design.

Further, the second passage portion 45*b* is bent at an obtuse angle in the flow direction of the air F. With this configuration, pressure loss when the air F flows through the second passage portion 45*b* can be reduced. Accordingly, the toilet device 10 makes it possible to improve the deodorization performance of the deodorizing unit 30.

Further, the casing 20 includes the fixing portions 21*a* for fixing the fan 60 with screws. Fixing the fan 60 to the fixing portions 21*a* of the casing 20 with screws makes it possible to help prevent displacement of the fan 60 due to vibration or the like. Accordingly, the deodorization performance of the deodorizing unit 30 can be improved. Further, a structure in which the fan 60 is fixed to the fixing portion 21*a* by screws is more durable than a structure in which the fan 60 is fixed by hooks, for example. Accordingly, it is possible to suppress breakage of the fixing portion 21*a* and help prevent having to replace the entire casing 20 due to the fixing portion 21*a* breaking, for example.

Note that, in the embodiment described above, a case in which the duct 40 is provided integrally with the case plate 21 is described as an example. However, aspects of the present invention are not limited to the above example. For example, the duct may be provided integrally with the case cover 28 of the casing 20.

In the embodiment described above, a case in which the exhaust port 43 is provided in the left side surface portion of the casing 20 is described as an example. However, aspects of the present invention are not limited to the above example. For example, the exhaust port may be provided in a rear surface portion or a right side surface portion of the casing 20.

In the embodiment described above, a case in which the intake 41 is provided above the bowl portion 2*a* and the air in the bowl portion 2*a* is suctioned is described as an example. However, aspects of the present invention are not limited to the above example. For example, the intakes may be provided in a front surface portion, a rear surface portion, and a right side surface portion of the casing 20 to suction the air in the toilet room.

Further, in the embodiment described above, a case in which both the first passage portion 45*a* and the second passage portion 45*b* are integrated with the case plate 21 of the casing 20 is described as an example. However, aspects of the present invention are not limited to the above example. For example, only one of the first passage portion 45*a* and the second passage portion 45*b* may be integrated with the casing 20. Further, for example, the first passage portion 45*a* may be integrated with the case plate 21 and the second passage portion 45*b* may be integrated with the case cover 28, or the first passage portion 45*a* may be integrated with the case cover 28 and the second passage portion 45*b* may be integrated with the case plate 21.

The embodiments may include the following configurations.

Configuration 1

A toilet device including:
- a casing; and
- a deodorizing unit provided inside the casing and configured to deodorize air in a toilet room, wherein
- the deodorizing unit includes
- a duct, and
- a fan configured to suction air into the duct,
- the duct includes
- a first extending portion extending from the casing,
- a second extending portion extending from the casing at a position different from a position of the first extending portion, and
- a connection portion connecting the first extending portion and the second extending portion, and
- the first extending portion, the second extending portion, and the connection portion are integrally formed with the casing.

Configuration 2

The toilet device according to configuration 1, wherein
- the duct includes
- an intake through which air is suctioned,
- an exhaust port from which deodorized air is exhausted, and
- a passage portion via which the intake and the exhaust port communicate with each other, the passage portion being formed by the first extending portion, the second extending portion, and the connection portion, and
- the passage portion is integrally formed with the casing from the intake to the exhaust port.

Configuration 3

The toilet device according to configuration 2, wherein
- the fan includes a rotary shaft extending upward with respect to a bottom surface portion of the casing, and
- the fan exhausts air in a direction orthogonal to the rotary shaft.

Configuration 4

The toilet device according to configuration 2 or 3, wherein
- the passage portion includes
- a first passage portion positioned on the intake side, and
- a second passage portion positioned on the exhaust port side, and
- the fan is disposed between the first passage portion and the second passage portion.

Configuration 5

The toilet device according to configuration 4, wherein
- the second passage portion is bent at an obtuse angle in a flow direction of air.

Configuration 6

The toilet device according to any one of configurations 1 to 5, wherein
- the casing includes a fixing portion at which the fan is fixed with a screw.

Embodiments of the present invention have been described above. However, the present invention is not limited to the above description. Those skilled in the art can suitably modify the above embodiments, and such modifications are also encompassed within the scope of the present invention as long as they include the features of the present invention. For example, the shape, dimension, material, arrangement, installation type, and the like of each element included in the toilet device are not limited to those illustrated and can be modified as desired. Furthermore, the elements in the above embodiments can be combined with each other as long as technically feasible. Such combinations are also encompassed within the scope of the present invention as long as they include the features of the present invention.

What is claimed is:

1. A toilet device comprising:
a casing; and
a deodorizing unit provided inside the casing and configured to deodorize air in a toilet room, wherein
the deodorizing unit includes
a duct, and
a fan configured to suction air into the duct,
the duct includes
a first extending portion extending from the casing,
a second extending portion extending from the casing at a position different from a position of the first extending portion,
a connection portion connecting the first extending portion and the second extending portion, and
an attaching portion for attaching the fan to the duct, and
the first extending portion, the second extending portion, and the connection portion are integrally formed with the casing, and
the attaching portion is open upward.

2. The toilet device according to claim 1, wherein
the duct includes
an intake through which air is suctioned,
an exhaust port from which deodorized air is exhausted, and
a passage portion via which the intake and the exhaust port communicate with each other, and
the passage portion is integrally formed with the casing from the intake to the exhaust port.

3. The toilet device according to claim 2, wherein
the fan includes a rotary shaft extending upward with respect to a bottom surface portion of the casing, and
the fan exhausts air in a direction orthogonal to the rotary shaft.

4. The toilet device according to claim 2, wherein
the passage portion includes
a first passage portion positioned on the intake side, and
a second passage portion positioned on the exhaust port side, and
the fan is disposed between the first passage portion and the second passage portion.

5. The toilet device according to claim 4, wherein
the second passage portion is bent at an obtuse angle in a flow direction of air.

6. The toilet device according to claim 1, wherein
the casing includes a fixing portion at which the fan is fixed with a screw.

7. A toilet device comprising:
a casing; and
a deodorizing unit provided inside the casing and configured to deodorize air in a toilet room, wherein
the deodorizing unit includes
a duct, and
a fan configured to suction air into the duct,
the duct includes
an intake through which air is suctioned,
an exhaust port from which deodorized air is exhausted, and
a passage portion via which the intake and the exhaust port communicate with each other, the passage portion being formed by a first extending portion extending from the casing, a second extending portion extending from the casing at a position different from a position of the first extending portion, and a connection portion connecting the first extending portion and the second extending portion, and wherein
the first extending portion, the second extending portion, and the connection portion are integrally formed with the casing from the intake to the exhaust port.

8. The toilet device according to claim 7, wherein
the fan includes a rotary shaft extending upward with respect to a bottom surface portion of the casing, and
the fan exhausts air in a direction orthogonal to the rotary shaft.

9. The toilet device according to claim 7, wherein
the passage portion includes
a first passage portion positioned on the intake side, and
a second passage portion positioned on the exhaust port side, and
the fan is disposed between the first passage portion and the second passage portion.

10. The toilet device according to claim 9, wherein
the second passage portion is bent at an obtuse angle in a flow direction of air.

11. The toilet device according to claim 7, wherein
the casing includes a fixing portion at which the fan is fixed with a screw.

12. A toilet device comprising:
a casing; and
a deodorizing unit provided inside the casing and configured to deodorize air in a toilet room, wherein
the deodorizing unit includes
a duct, and
a fan configured to suction air into the duct,
the duct includes
a first extending portion extending from the casing,
a second extending portion extending from the casing at a position different from a position of the first extending portion, and
a connection portion connecting the first extending portion and the second extending portion, and
the first extending portion, the second extending portion, and the connection portion are integrally formed with the casing, wherein
the casing includes a fixing portion at which the fan is fixed with a screw.

* * * * *